US006361349B1

(12) United States Patent
Hung

(10) Patent No.: US 6,361,349 B1
(45) Date of Patent: Mar. 26, 2002

(54) HIGH VOLTAGE CONNECTOR

(75) Inventor: Chih-Chien Hung, Taoyuan (TW)

(73) Assignee: Darfon Electronics Corp., Kweishan Taoyuan (TW)

( * ) Notice: Subject to any disclaimer, the term of this patent is extended or adjusted under 35 U.S.C. 154(b) by 0 days.

(21) Appl. No.: 09/739,625

(22) Filed: Dec. 20, 2000

Related U.S. Application Data

(63) Continuation of application No. 09/196,755, filed on Nov. 20, 1998, now Pat. No. 6,186,818.

(30) Foreign Application Priority Data

Jun. 29, 1998 (TW) ..... 87210422 U

(51) Int. Cl.[7] ..... H01R 13/267
(52) U.S. Cl. ..... 439/357; 439/345
(58) Field of Search ..... 439/357, 350, 439/351, 352, 353, 354, 355, 356, 358, 345

(56) References Cited

U.S. PATENT DOCUMENTS 5,711,684 A * 1/1998 Inoue et al. ..... 439/354
6,186,818 B1 * 2/2001 Hung ..... 439/354

* cited by examiner

*Primary Examiner*—Gary Paumen
*Assistant Examiner*—Alexander Gilman
(74) *Attorney, Agent, or Firm*—Ladas & Parry

(57) ABSTRACT

A high voltage connector for connecting a lead wire to a high voltage device. The connector includes: an inner sleeve having a bore for receiving and fixing the lead wire and a protrusion formed on the outer peripheral surface thereof; and an outer sleeve disposed on the high voltage device, having a bore for receiving the inner sleeve and a hole formed on the outer peripheral surface thereof for engaging with the protrusion of the inner sleeve. The hole of the outer sleeve is not a cut from the top end surface thereof and thus the end surface is not discontinuous. The outer sleeve also includes a guiding member for guiding the protrusion of the inner sleeve.

13 Claims, 7 Drawing Sheets

HIGH VOLTAGE CONNECTOR

This application is a continuation of the application Ser. No. 09/196,755, filed on Nov. 20, 1998 now U.S. Pat. No. 6,186,818.

FIELD OF THE INVENTION

The present invention relates to a high-voltage connector and in particular to a high-voltage connector for use in a flyback transformer.

DESCRIPTION OF PRIOR ART

Referring to FIG. 1*a*, a conventional high voltage connector for using in a flyback transformer includes an inner sleeve 3 and an outer sleeve 1 protruded from a casing 15 of a flyback transformer (not shown). A high voltage lead wire 2 is fitted in and fixed onto the inner peripheral surface of the inner sleeve 3 so that when the inner sleeve 3 is fitted in the outer sleeve 1, the bottom end of the high voltage lead wire 2 is connected to a coil (not shown) in the casing 15. As can be seen from FIG. 1*a*, the inner sleeve 3 has a circular flange 33 formed on its top end surface, a long protrusion 32 formed along its longitudinal axis on the outer peripheral surface thereof and a long protrusion 31 formed horizontally on the outer peripheral surface thereof. The outer sleeve 1 includes a vertical cut formed from its top end surface 12 along its longitudinal axis and a horizontal cut 14 extended from the bottom end of the vertical cut 13. The inner sleeve 3 and the outer sleeve 1 are both made of plastics. In the assembly of the high voltage connector, the inner sleeve 3 is inserted and pressed into the outer sleeve 1 so that the long protrusion 32 is moved in the vertical cut 13, thereby bringing the protrusion 31 into engagement with the horizontal cut 14 with the circular flange 33 abutting the top end surface 12 of the inner sleeve 3, as shown in FIG. 1*b*.

This conventional arrangement has the advantage of easy assembling; however, it has the following problems. The vertical cut 13 is cut from the top end surface 12 of the outer sleeve 1, making the top end surface 12 discontinuous, and thus the tensile strength of the outer sleeve 13 is reduced. Breakage of the high voltage connector may occur when the inner sleeve 3 is pressed in the outer sleeve 1. Also, no guiding means is provided on the outer sleeve 1, and thus it may difficult to align the protrusion 32 with the vertical cut 13 in the assembly operation, resulting in defective items.

SUMMARY OF THE INVENTION

It is therefore an object of the invention to provide a high voltage connector which can eliminate the above prior art problems.

To this end, according to the invention, there is provided a high voltage connector for connecting a lead wire to a high voltage device, including: an inner sleeve having a bore for receiving and fixing the lead wire and a protrusion formed on the outer peripheral surface thereof; and an outer sleeve disposed on the high voltage device, having a bore for receiving the inner sleeve and a hole formed on the outer peripheral surface thereof for engaging with the protrusion of the inner sleeve. The hole of the outer sleeve is not a cut from the top end surface thereof and thus the end surface is not discontinuous; thereby, the tensile strength of the outer sleeve is not reduced. The outer sleeve also includes a guiding means for guiding the protrusion of the inner sleeve; thereby, the assembling operation is easier.

According to an aspect of the invention, there is also provided a high voltage connector for connecting a lead wire to a high voltage device, including: an inner sleeve having a bore for receiving and fixing the lead wire, a hole formed on the outer peripheral surface thereof; and an outer sleeve disposed on the high voltage device, having a bore for receiving the inner sleeve, a protrusion disposed on the inner peripheral surface thereof for engaging with the hole of the inner sleeve. The hole is formed on the outer peripheral surface of the inner sleeve and the protrusion is formed on the inner peripheral surface of the outer sleeve, and thus the outer sleeve is not easily broken when the inner sleeve is pressed into and engaged with the outer sleeve. The inner sleeve is also provided with a protrusion for receiving a guiding groove formed on the inner peripheral surface of the outer sleeve. Alternatively, the guiding groove can be provided on the outer peripheral surface of the inner sleeve for receiving a protrusion formed on the inner peripheral surface of the outer sleeve.

BRIEF DESCRIPTION OF THE DRAWINGS

The present invention is hereinafter described in detail by the preferred embodiments with reference to the accompanying drawings wherein.

DETAILED DESCRIPTION OF THE PREFERRED EMBODIMENTS

Figure 1A:
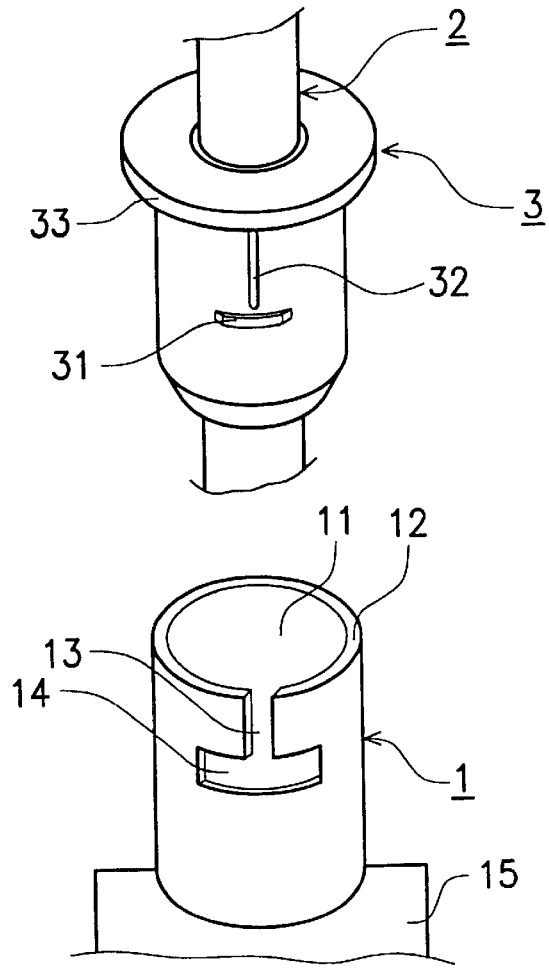
FIG. 1a (PRIOR ART)
FIG. 1*a* is an exploded perspective view showing the high voltage connector for a flyback transformer according the prior art.
Figure 1B:
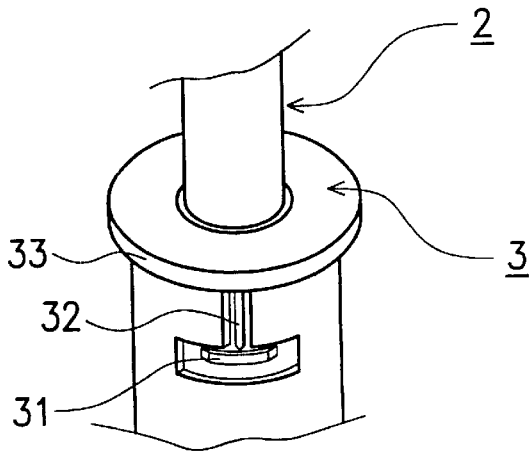
FIG. 1b (PRIOR ART)
FIG. 1*b* is a perspective view showing the assembled high voltage connector of FIG. 1*a;*
Figure 2:
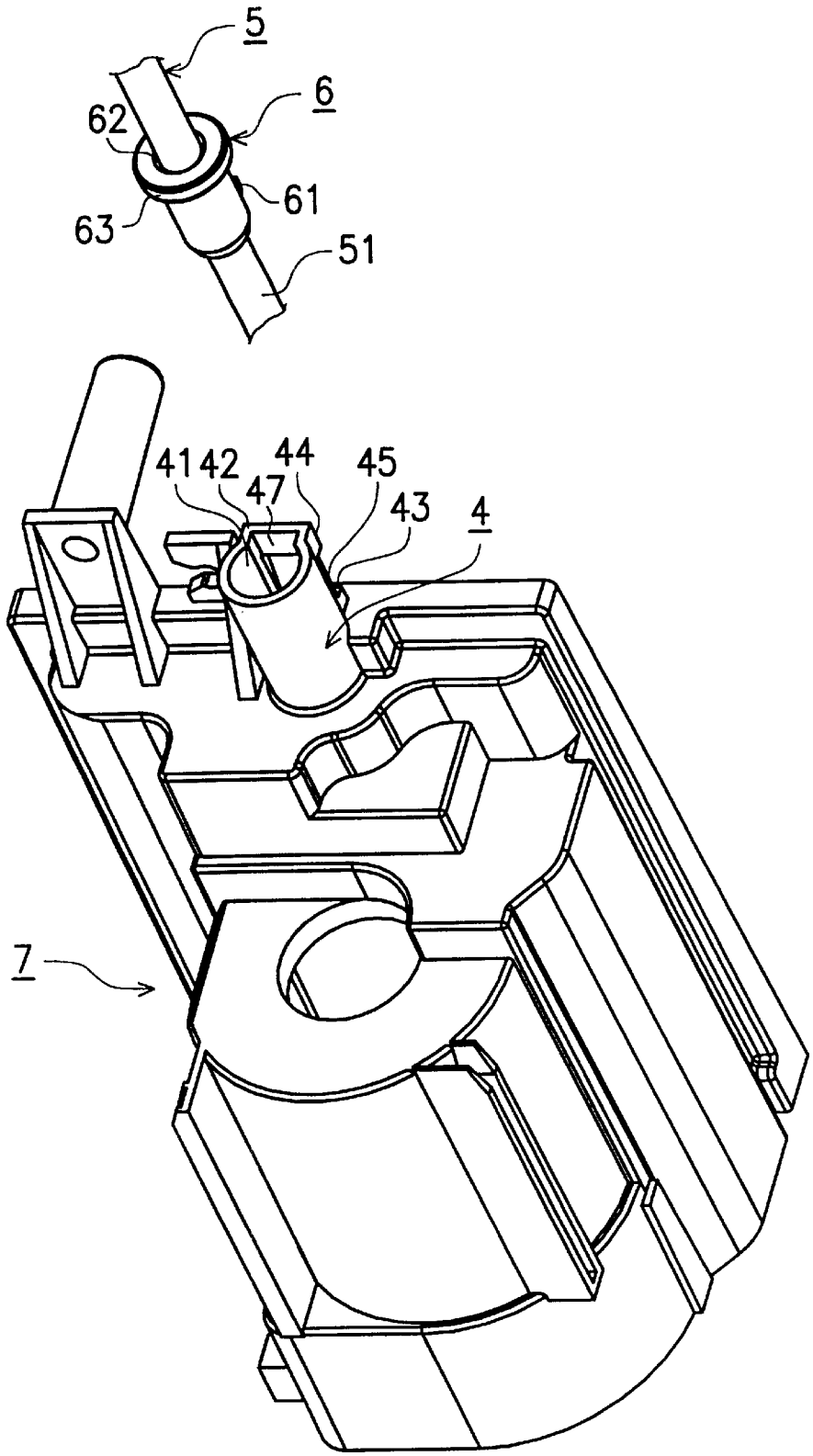
FIG. 2 is a perspective view showing the high voltage connector according to the first embodiment of the invention in a state in which the lead wire fitted in an inner sleeve is ready to be pressed into the outer sleeve disposed on a flyback transformer.
Figure 3A:
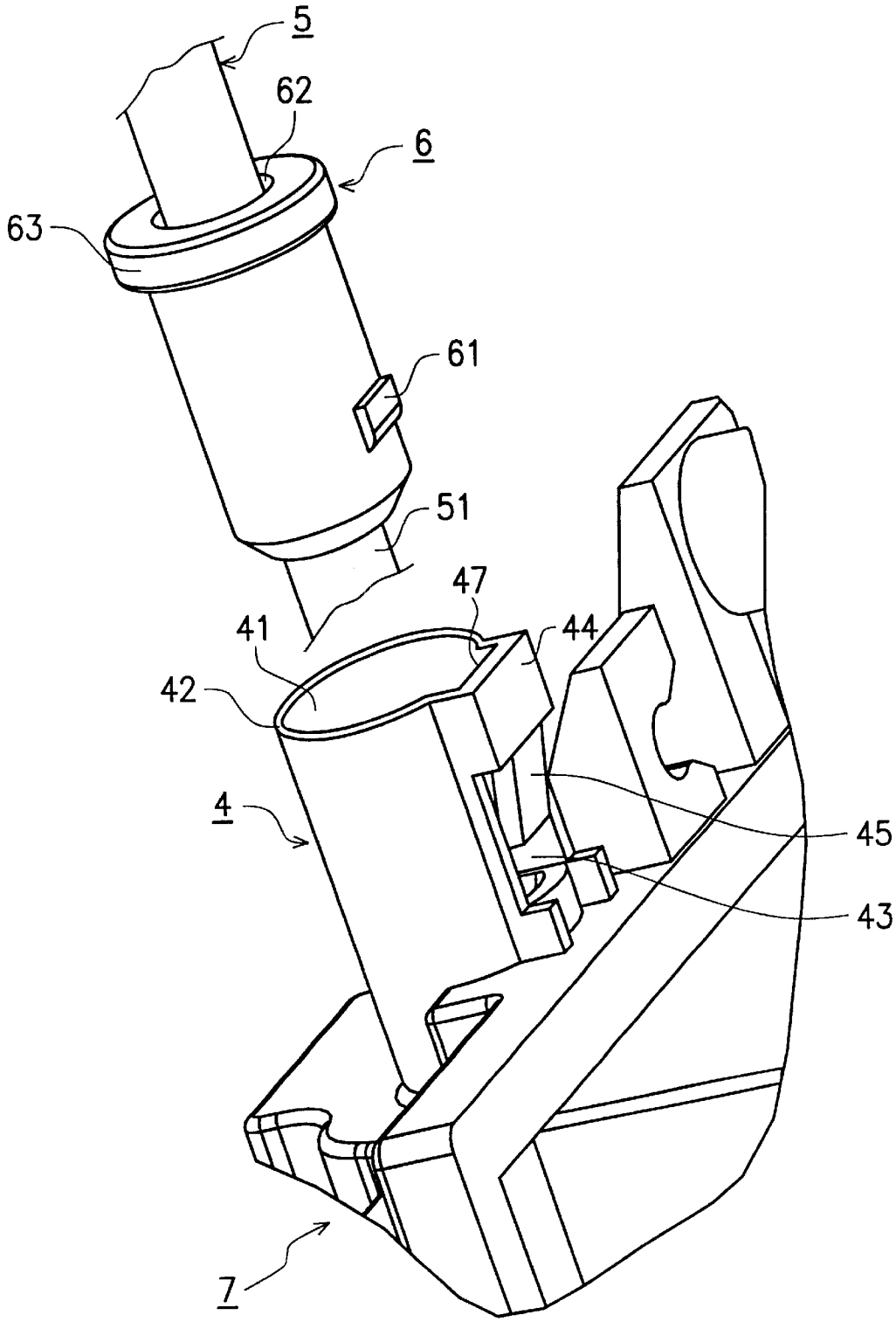
FIG. 3*a* is a partial enlarged perspective view of FIG. 2.
Figure 3B:
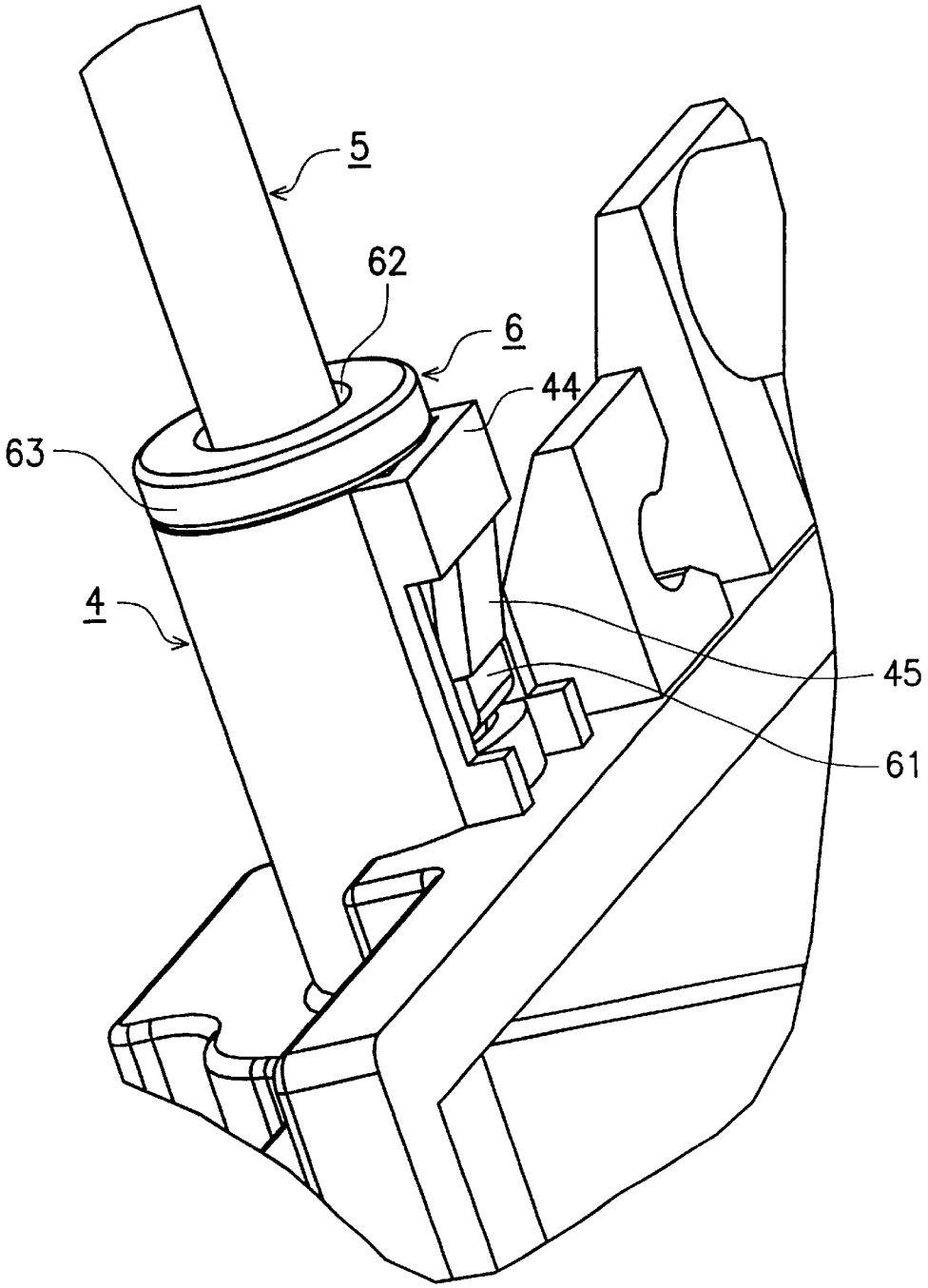
FIG. 3*b* is a partial enlarged perspective view showing the high voltage connector according to the first embodiment of the invention in an assembled state with the lead wire connected therein.
Figure 4:
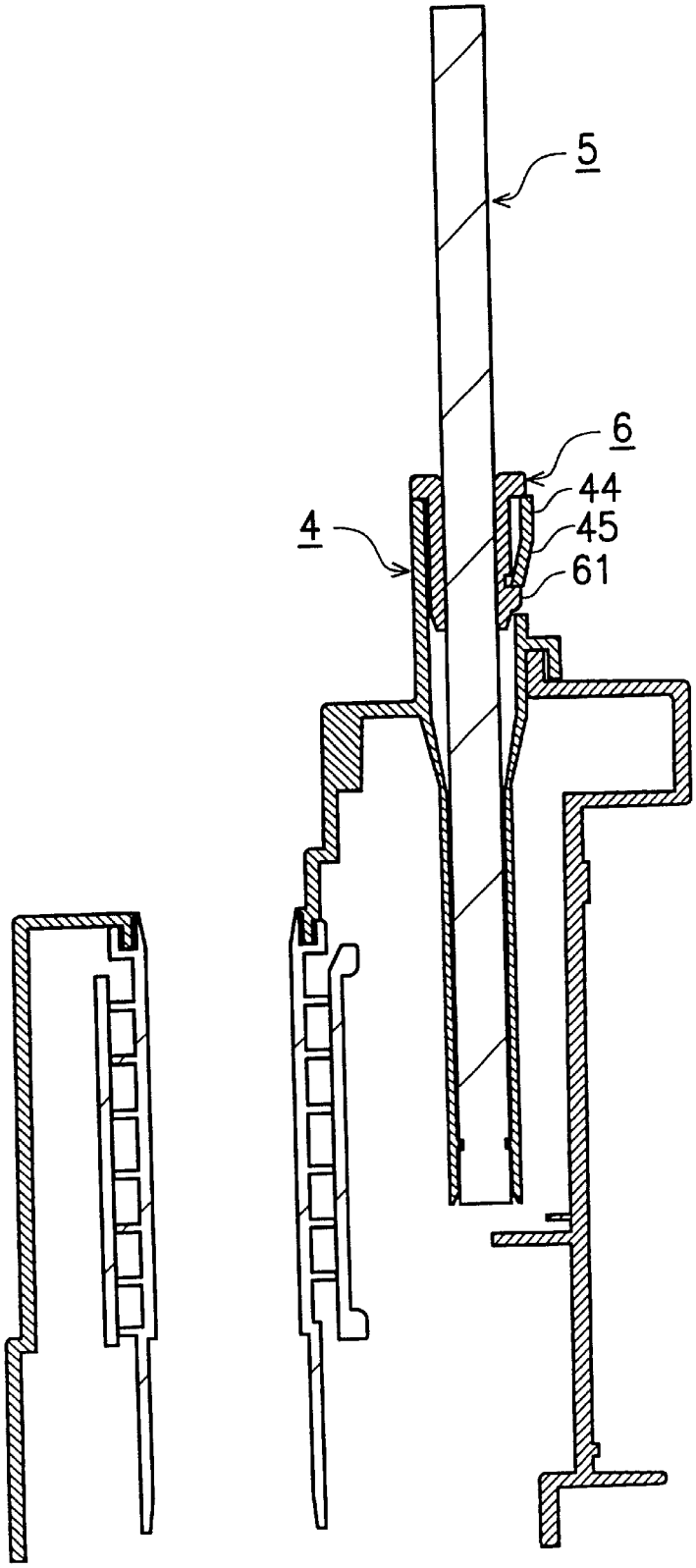
FIG. 4 is a sectional view of FIG. 3*b;*

Referring to FIG. 2 and FIG. 3*a*, a high voltage lead wire 5 is fitted and fixed in the bore 62 of an inner sleeve 6 with its bottom end 51 protruded therefrom for being connected to a coil (not shown) in a flyback transformer 7. The inner sleeve 6 is provided with a circular flange 63 and a protrusion 61 formed on the outer peripheral surface thereof. The inner sleeve 6 is pressed in the bore 41 of an outer sleeve 4 disposed on the top of the casing of the flyback transformer 7. The outer sleeve 4 is provided with a hole 43 on the outer peripheral surface thereof. The hole 43 is a slot formed along the longitudinal axis of the outer sleeve 7 for engaging with the protrusion 61 of the inner sleeve 6 when it is pressed in. A guiding groove 47 is formed on the outer peripheral surface of the outer sleeve 4 from the top end surface 42 extending a predetermined length to form a rectangular protrusion 44 along the longitudinal axis thereof. The outer sleeve 4 also includes a retaining member 45 which is made of elastic material such as plastics, formed at the lower end of the rectangular protrusion 44 along the longitudinal axis of the outer sleeve 44. When the inner sleeve 6 is pressed in the outer sleeve 4 and the protrusion 61 is protruded from the hole 43, the retaining member 45 can retain the protrusion 61 against withdrawal of the inner sleeve 6. This mechanism can be more clearly understood from FIG. 3*b* and FIG. 4 which respectively show the assembled state of the high voltage connector with the lead wire connected therein and a sectional view thereof.

Figure 5:
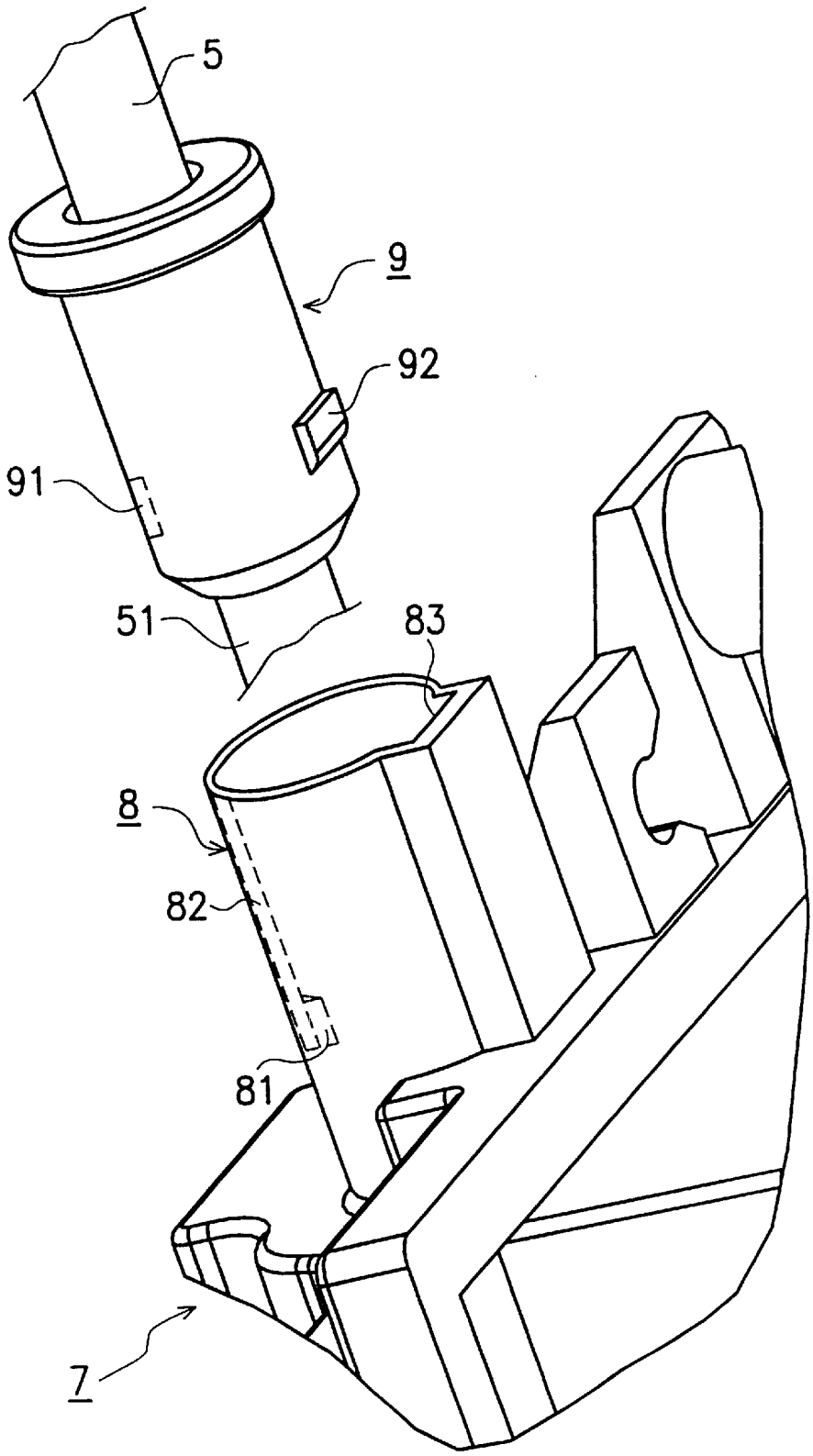
FIG. 5 is a partial perspective view showing the high voltage connector according to the second embodiment of the invention in a state in which the lead wire fitted in an inner sleeve is ready to be pressed into the outer sleeve disposed on a flyback transformer.

Referring now to FIG. 5, a second embodiment of the high voltage connector of the invention is shown in a state in which the lead wire 5 fitted in an inner sleeve 9 is ready to be pressed into the outer sleeve 8 disposed on a flyback transformer 4. In this embodiment, a protrusion 92 and a hole 91 are respectively formed on the outer peripheral surface of the inner sleeve 9 along the longitudinal axis thereof while a guiding groove 83 and a protrusion 81 are respectively formed on the outer peripheral surface and the inner peripheral surface along the longitudinal axis thereof. The guiding groove 83 is used for guiding the protrusion 92 when the inner sleeve 9 is pressed in the outer sleeve 8. The protrusion 81 is formed on one end of an arm 82 whose other end is mounted and extended from the end surface of the outer sleeve 8. The arm 82 is made of an elastic material and is extended into the bore of the outer sleeve 8 for a predetermined length along the longitudinal axis thereof. In this way, when the inner sleeve 9 is pressed into the outer sleeve 8, the protrusion 81 can be snapped into and engaged with the hole 91 by aligning the protrusion 92 in the guiding groove 83.

Figure 6:
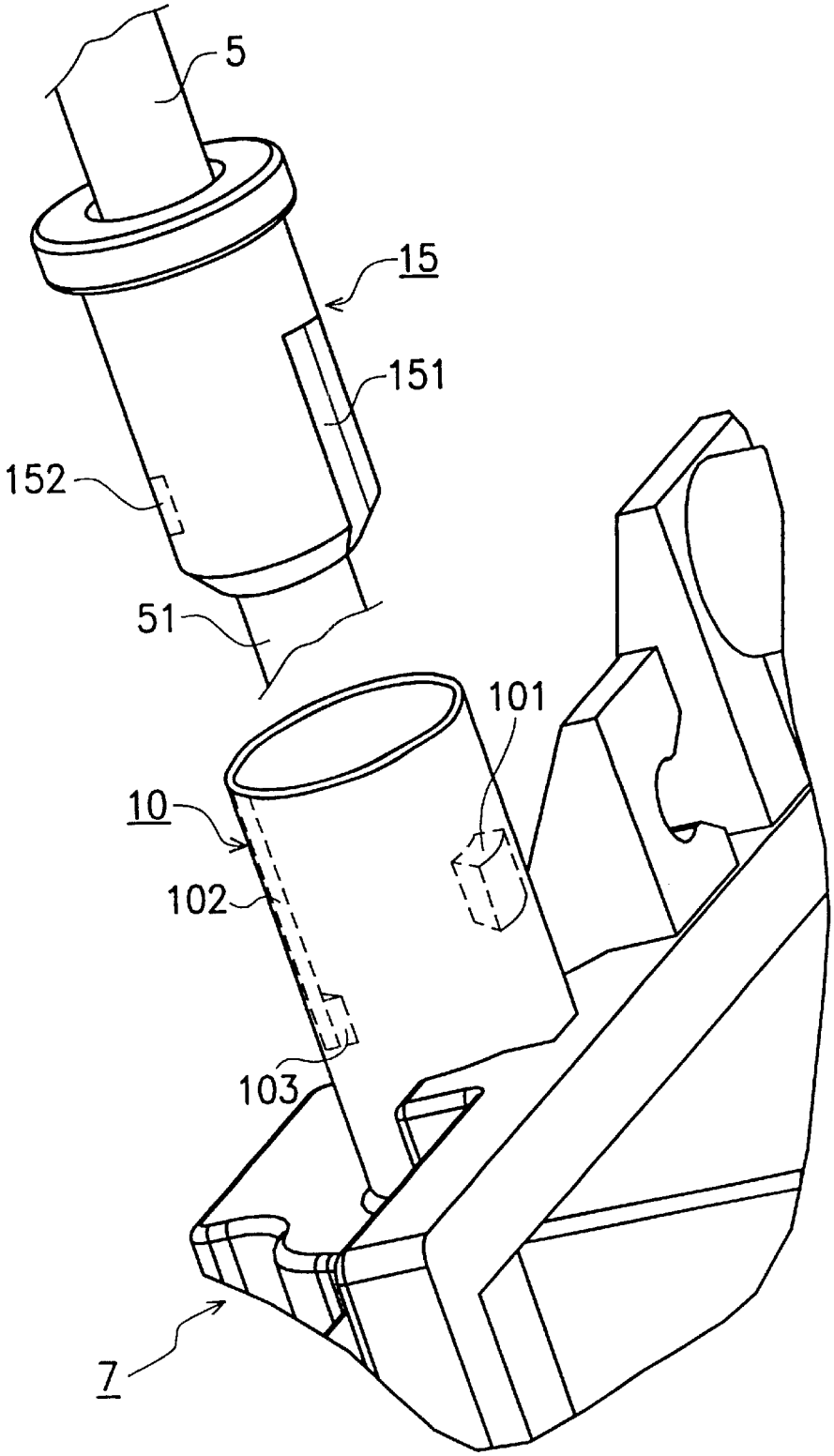
FIG. 6 is a partial perspective view showing the high voltage connector according to the third embodiment of the invention in a state in which the lead wire fitted in an inner sleeve is ready to be pressed into the outer sleeve disposed on a flyback transformer.

Referring now to FIG. 6, a third embodiment of the high voltage connector of the invention is shown in a state in which the lead wire 5 fitted in an inner sleeve 15 is ready to be pressed into the outer sleeve 10 disposed on a flyback transformer 4. In this embodiment, the guiding groove 151 is a rectangular recessed portion 151 formed on the outer peripheral surface of the inner sleeve 15 along the longitudinal axis thereof. The guiding groove 151 is used for guiding the protrusion 101 formed on the inner peripheral surface of the outer sleeve 10. In a similar manner, a hole 152 is formed on the outer peripheral surface of the inner sleeve 15 along the longitudinal axis thereof while a protrusion 103 is formed on the inner peripheral surface along the longitudinal axis of the outer sleeve 10 thereof. The protrusion 103 is formed on one end of an arm 102 whose other end is mounted and extended from the end surface of the outer sleeve 10. The arm 102 is made of an elastic material and is extended into the bore of the outer sleeve 10 for a predetermined length along the longitudinal axis thereof. In this way, when the inner sleeve 15 is pressed into the outer sleeve 10, the protrusion 103 can be snapped into and engaged with the hole 152 by aligning the protrusion 101 in the guiding groove 151.

What is claimed is:

1. A connector for connecting a lead wire to a high voltage device, comprising:

an inner sleeve having a first bore for receiving and fixing the lead wire and a substantially non-resilient protrusion formed on the outer peripheral surface thereof; and an outer sleeve constructed and arranged so as to be disposed on the high voltage device, having a second bore for receiving said inner sleeve, a guiding groove formed on the outer peripheral surface thereof for receiving said protrusion of said inner sleeve, and a resilient retaining member disposed in said guiding groove for engaging with said protrusion to secure said inner sleeve to said outer sleeve;

said second bore of said outer sleeve having a top end surface, wherein said top end surface forms a continuous, enclosed outline with respect to a plane such that no perpendicular cuts or slots are formed along said top end surfaces.

2. The connector as claimed in claim 1, further comprising a hole on the outer peripheral surface of said guiding groove exposing at least a portion of said protrusion when said inner sleeve is secured to said outer sleeve.

3. The connector as claimed in claim 1, wherein said inner sleeve includes a flange formed on the end surface opposite to said outer sleeve so that when said inner sleeve is received in said outer sleeve, the flange becomes abutted with the end surface of the outer sleeve.

4. The connector as claimed in claim 1, wherein said high voltage device is a flyback transformer.

5. The connetor as claimed in claim 1, wherein said outer sleeve is integrally formed with the high voltage device.

6. The connector as claimed in claim 1, wherein said retaining member is made of elastic materials.

7. A connector for connecting a lead wire to a high voltage device, comprising:

an inner sleeve having a first bore for receiving and fixing the lead wire and a protrusion formed on the outer peripheral surface thereof; and an outer sleeve constructed and arranged so as to be disposed on the high voltage device, having a second bore for receiving said inner sleeve, a guiding groove formed on the outer peripheral surface thereof for receiving said protrusion of said inner sleeve, and a retaining member made of elastic materials and formed on the outer peripheral surface thereof for retaining said protrusion against withdrawal of said inner sleeve;

said second bore of said outer sleeve having a top end surface, wherein said top end surface forms a continuous, enclosed outline with respect to a plane such that no perpendicular cuts or slots are formed along said top end surfaces.

8. A connector for connecting a lead wire to a high voltage device, comprising:

an inner sleeve having a first bore for receiving and fixing the lead wire, a guiding groove and a hole formed in the outer peripheral surface thereof;

an outer sleeve constructed and arranged so as to be disposed on the high voltage device, having a second bore for receiving said inner sleeve, a first protrusion for being received in to said guiding groove formed on the inner peripheral surface thereof; and a resilient retaining member disposed on the inner peripheral surface of said outer sleeve for engaging with said hole to secure said inner sleeve to said outer sleeve;

wherein said second bore of said outer sleeve has a top end surface, wherein said top end surface forms a continuous, enclosed outline with respect to a plane such that no perpendicular cuts or slots are formed along said top end surface.

9. The connector as claimed in claim 8, wherein said resilient retaining member comprises an arm formed of elastic material and a protrusion, wherein said protrusion is received into said hole when said inner sleeve is secured to said outer sleeve.

10. The connector as claimed in claim 8, wherein said guiding groove is a slot formed along the longitudinal axis of said first bore.

11. The connector as claimed in claim 8, wherein said inner sleeve includes a flange formed on the end surface opposite to said outer sleeve so that when said inner sleeve is received in said outer sleeve, the flange becomes abutted with the end surface of the outer sleeve.

12. The connector as claimed in claim 8, wherein said high voltage device is a flyback transformer.

13. The connector as claimed in claim 8, wherein said outer sleeve is integrally formed with the high voltage device.

* * * * *